US005865390A

United States Patent [19]

Iveges

[11] Patent Number: 5,865,390

[45] Date of Patent: Feb. 2, 1999

[54] VARIABLE-LENGTH ANTENNA ELEMENT

[76] Inventor: Steve I Iveges, 33 Isabella St. Suite 1711, Toronto, ON, Canada, M4Y 2P7

[21] Appl. No.: 736,549

[22] Filed: Oct. 24, 1996

[51] Int. Cl.[6] ..... B65H 75/48; H01Q 1/08; H01Q 1/12

[52] U.S. Cl. ..... 242/375; 242/390.2; 343/877

[58] Field of Search ..... 242/375, 375.2, 242/390.2, 390.3; 343/877

[56] References Cited

U.S. PATENT DOCUMENTS

| | | | |
|---|---|---|---|
| 1,438,290 | 12/1922 | Beakes | 343/877 |
| 1,860,128 | 5/1932 | Bethenod | 343/877 |
| 1,913,209 | 6/1933 | Nixdorff | 242/877 |
| 2,036,456 | 4/1936 | Buschbeck | 343/877 |
| 2,276,935 | 3/1942 | Como | 242/390.3 |
| 2,709,220 | 5/1955 | Spector | 242/390.2 |
| 2,834,012 | 5/1958 | Allen | 343/877 |
| 3,268,903 | 8/1966 | Kuecken et al. | 343/877 |
| 3,541,568 | 11/1970 | Lowenhar | 343/877 |
| 4,142,693 | 3/1979 | Czerwinski | 242/375 |
| 4,434,952 | 3/1984 | Czerwinski et al. | 242/375.2 |
| 4,972,601 | 11/1990 | Bickford et al. | 242/375 |
| 5,221,930 | 6/1993 | Scott | 343/877 |
| 5,370,334 | 12/1994 | Shinkawa et al. | 242/390.2 |

FOREIGN PATENT DOCUMENTS

| | | | |
|---|---|---|---|
| 2311419 | 12/1976 | France | 343/877 |

*Primary Examiner*—John M. Jillions

[57] ABSTRACT

Continously variable-length antenna, operating in a wide frequency range that's simple, lightweight and reliable, and can be constructed by using a metal case-resided, coiled steel band spring returnable metal tape for the actual antenna, and pulling or releasing it by a thin insulating line. A strong, lightweight insulating tube, guiding the metal tape in its mechanical excursions, also provides for weatherproof construction. Remote controlling and an extremely wide range of antenna lengths can easily be realized.

6 Claims, 3 Drawing Sheets

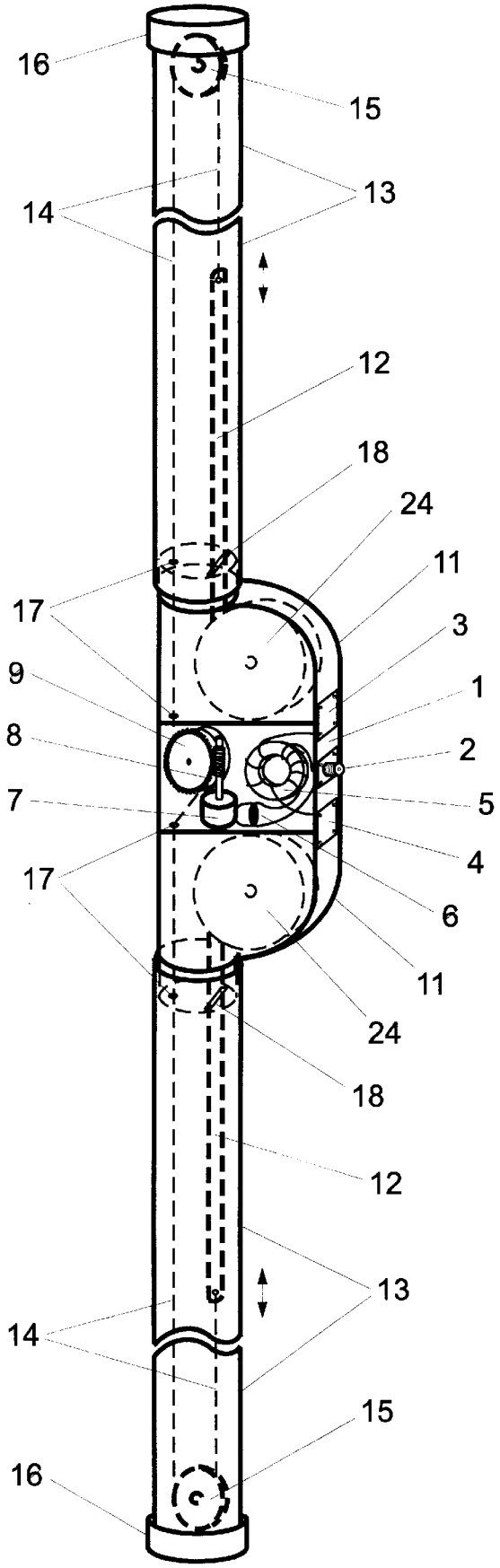
Fig.3
Fig.4
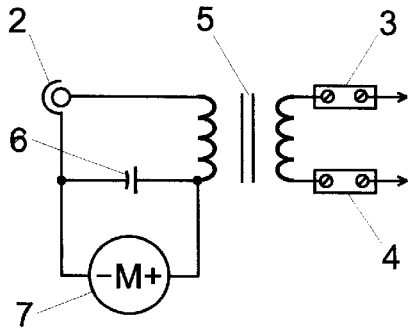

VARIABLE-LENGTH ANTENNA ELEMENT

BACKGROUND OF THE INVENTION

This invention relates to an easily realizable, remotely adjustable length of an antenna element (monopole) in order to extend the operating frequency range.

The proper length of an antenna monopole (single antenna element) or dipole (two antenna elements or monopoles), or any other type of antenna consisting of more monopoles, for a given feeding point (radio frequency signal connection point) and antenna impedance, is inversely proportional to the operating frequency. Proper operation of the same antenna at different frequencies or frequency bands is achieved with the length of the antenna being variable and preferably remotely adjustable for the current operating frequency. If the required operating frequency band is wide, the antenna length has to vary in a wide range from very short to very long. There are also other important factors, which any long (few tens of feet) antenna, meant for outside free air operation, should fulfill: reliable mechanical and electrical operation in any position, weatherproof and light-weight construction, etc.

One of the solutions for continuously varying the length of an antenna may be based on a telescope principle. Antennas utilizing this type of mechanism are widely found in automobiles, where the telescope feature is used to erect or retract the antenna manually or remotely. Such an antenna would be too heavy for having tens of feet in maximum length, with a complicated and bulky length-adjusting high-power mechanism. Since the telescope antenna consists of several moving sections, there would always be a potential problem of having poor electrical contact between the sections; furthermore, there is an inherent problem with the telescope principle: the minimum length of the antenna cannot be less than the length of its longest section.

Using a metal tape as the actual antenna, extended from a power returnable metal tape mechanism, would be a better solution. Length variation is easily achieved by just pulling out or releasing back the metal tape with a thin insulating line in a strong, lightweight insulating tube.

SUMMARY OF THE INVENTION

Using a coiled band spring returnable metal tape in a metal case for the actual antenna element, and pulling or releasing it (letting the coiled steel band spring, located inside the assembly, to pull it back) with the insulating line, makes the variable-length antenna mechanism simple, light-weight and reliable. Remote controlling and an extremely wide range of lengths can easily be achieved as well. A strong, lightweight insulating tube, guiding the metal tape for mechanical movements, also provides for weatherproof construction. Such an antenna element(s), can be used to build different types of variable-length antennas: Vertical or Ground Plane Monopole Antennas, Dipole Antennas, Multielement Antennas, etc.

BRIEF DESCRIPTION OF THE DRAWINGS

FIG. 3 is a perspective view of the inside construction of a variable-length dipole antenna, consisting of two variable-length antenna elements and one control and matching box in the middle. Such an antenna may operate as a standard dipole alone or as an active or passive element in a Multi-element Antenna system.

FIG. 4 shows the electrical connections of the variable-length dipole antenna.

NOTE: The elements on the drawings are not necessarily in the same scale.

DETAILED DESCRIPTION OF THE INVENTION

Figure 1:
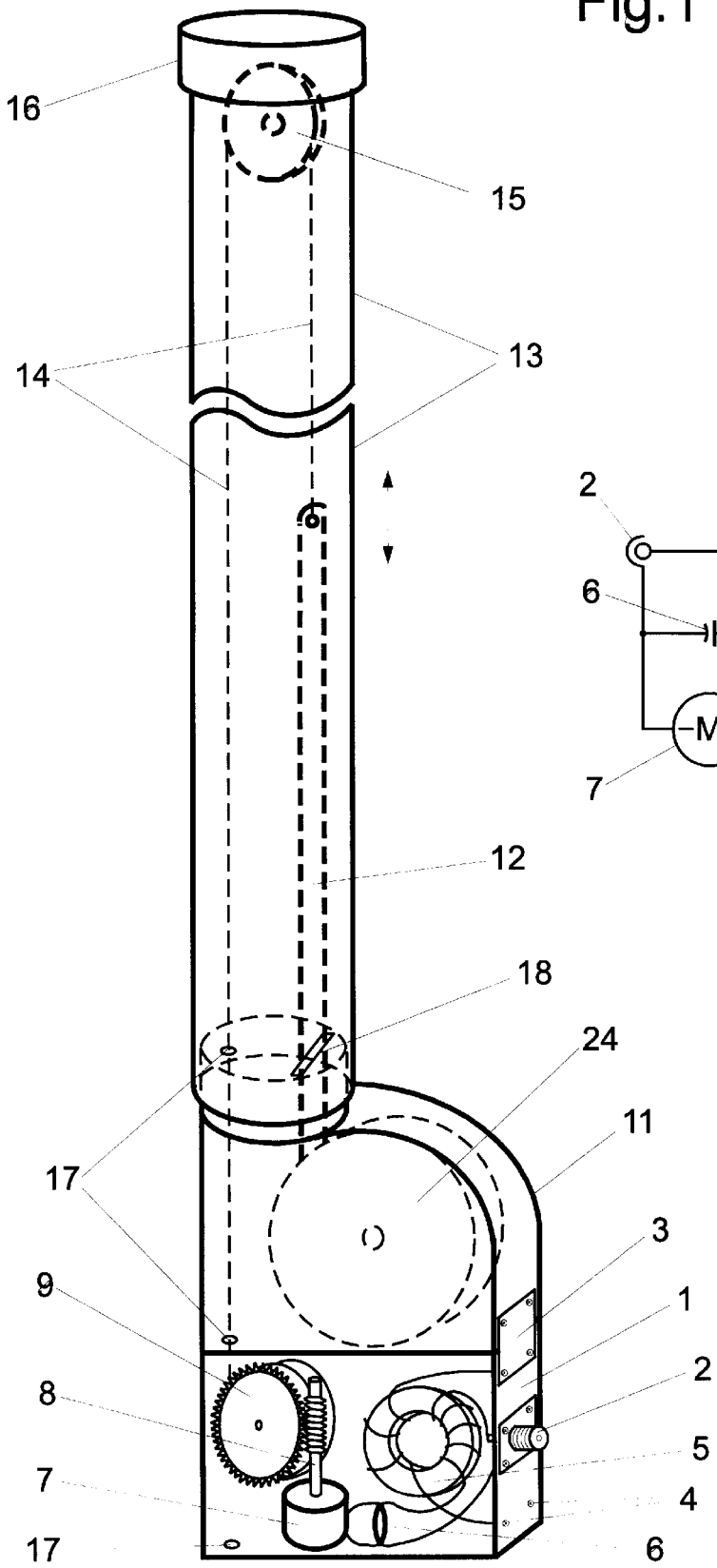
FIG. 1 is a perspective view of the inside construction of a variable-length antenna element with the control and matching box at the bottom end; this makes the single variable-length antenna element operate as a complete monopole antenna (Vertical Antenna or Ground Plane Antenna), using radial wires or ground for the second pole.
Figure 2:
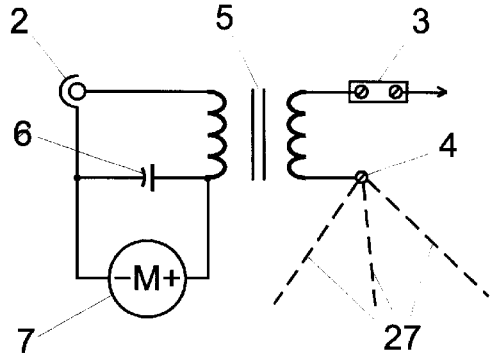
FIG. 2 shows the electrical connections of the single variable-length monopole antenna.

In FIG. 1 is the drawing which illustrates the entire invention. The actual antenna is the metal tape 12 which has a good conducting, non-oxidizing surface, pulled out by an insulating line 14 from the power returnable metal tape assembly in a metal case 11 through the slot 18. The insulating tube 13 guides the metal tape in its mechanical excursions, and together with cap 16 at its end provides a weatherproof construction. The thin insulating line is pulled or released on the pulley 15 at the tube end and through the holes 17 by the gear-driven reel 9 on which the rest of the line is wound up, and which is located in the antenna control and matching box 1. The gear and the reel 9 is driven by the endless worm gear 8 powered by a low-power DC motor 7, providing rotation in both directions depending on the polarity of the connected DC voltage. The monopole antenna element feeding point is at the lowest point of the metal tape assembly 11, and connects to the control and matching box by the connection plate 3. The metal body of the assembly 11 is also a part of the antenna, but due to its small dimensions and the antenna having low electrical impedance at that point, it makes no significant change in the overall characteristics of the antenna. The control and matching box 1 contains the radio frequency (RF) matching and insulating circuits of the antenna, as well as all the elements for the motorized remote controlling of the antenna length. FIG. 2 shows the electrical connections in the control and matching box 1. The antenna cable and the RF signal is connected by the antenna connector 2. Transformer 5 insulates and matches the antenna to the antenna feed line. The DC motor 7 is powered through the same antenna cable while capacitor 6 provides direct RF connection between the antenna connector 2 and the transformer 5. Connection plate 3 connects the actual antenna to one end of the transformer's secondary, while the other end, connection points 4, are for the connection of the antenna's second pole (another monopole, ground or radial wires 27). The control circuit for the DC motor 7, at the other end of the feed line, can be very sophisticated, which might be able to keep track of the actual antenna position: to stop the motor or change the direction at the extreme positions, as well as to constantly and automatically adjust the length of the antenna for optimum performance.

FIG. 3 illustrates how the variable-length antenna element is used for a dipole antenna (two monopoles) or a dipole element in the Multielement Antennas. In such antennas the particular elements may be positioned horizontally or vertically according to the required radiation pattern. FIG. 4 shows the connections in the control and matching box 1 in the case of a dipole antenna. The second monopole (the second variable-length antenna element in this case) is connected through the connection plate 4 to the other end of the transformer's secondary.

Figure 5:
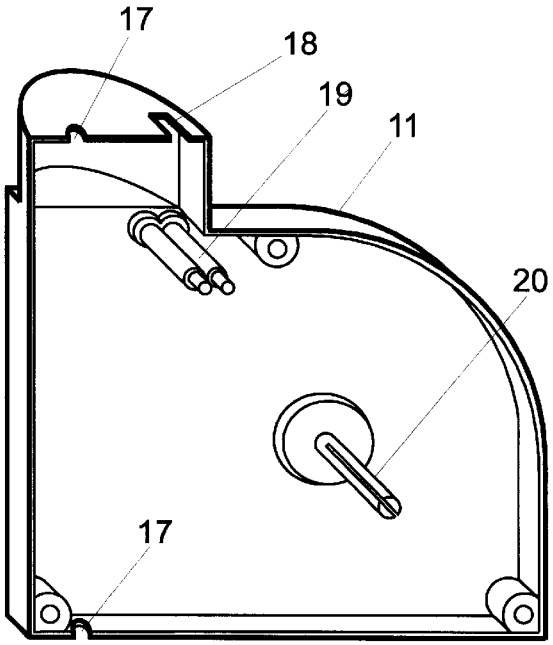
FIG. 5 and FIG. 8 are perspective views of the inner construction of both sides of the metal case which normally contains the metal tape and returning coiled steel band spring mechanism.
Figure 8:
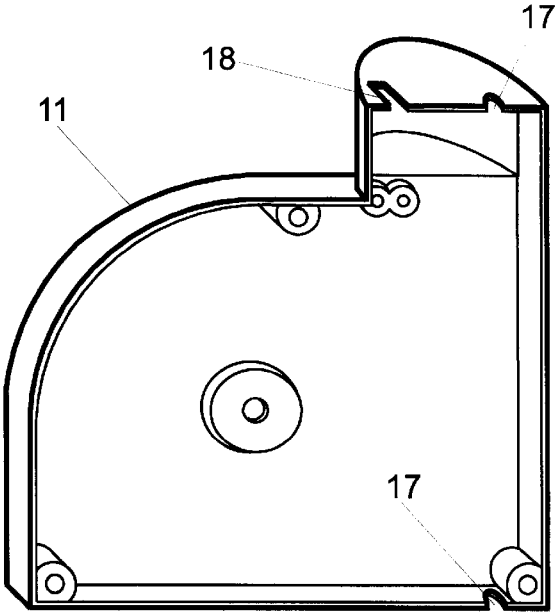

In FIG. 5 and FIG. 8, the inner construction of the power returnable metal tape assembly's metal housing 11 is shown. The metal tape is pressed inbetween the two metal rollers 19 and pulled out through the slot 18, while holes 17 are for the insulating line to pass through from the insulating tube to the control and matching box. The metal rollers 19 provide the mandatory good electrical contact between the metal tape 12 and the power returnable metal tape assembly's body 11, while introducing minimum extra braking force to the metal tape.

Figure 6:
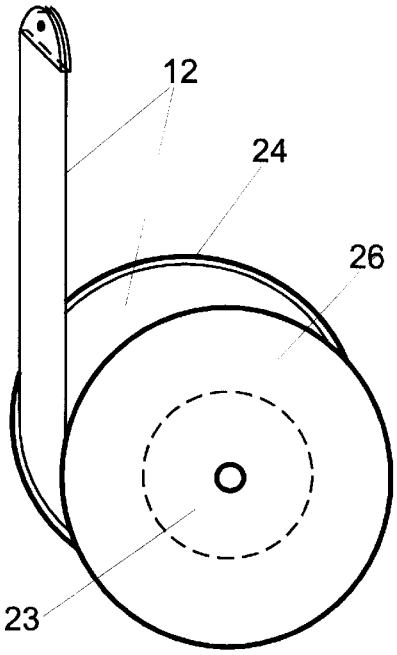
FIG. 6 is a perspective view of the spool mechanism for the metal tape and the coiled steel band spring fully loaded.
Figure 7:
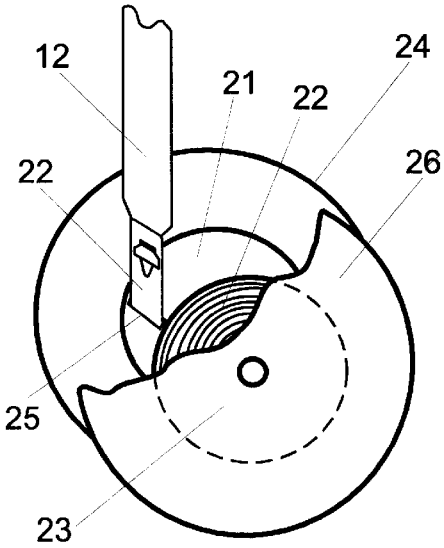
FIG. 7 is a perspective and detailed view of the spool mechanism's outer and inner compartments.

FIG. 6 and FIG. 7 illustrate the metal tape and steel band spring mechanism on a common spool 24. The spool is divided by a separating wall 21 into two compartments, the inner 23 and the outer 26. The steel band spring 22 resides in the inner compartment of the spool 24. The inner end of the steel band spring is bent and fixed through the slot of the fixed shaft 20 and then coiled onto that shaft. The other end of the spring comes out to the outer compartment through the slot 25 and tied with the inner end of the metal tape 12. The junction between the metal tape 12 and the steel band 22 is made so that the metal tape can easily be exchanged. The slot 25 is narrower than the metal tape 12, which thus can't be pulled into the inner compartment. The metal tape 12 is coiled in the outer compartment 26 of the spool 24. When a loaded spool resides on the shaft and wound up in the proper direction, the steel band spring tends to pull in the metal tape by rotating the spool in such a direction.

What I claim as my invention is:

1. A variable length antenna for electromagnetic wave radiation and reception and comprising;

a metal case, said case defining a slot;

a spool in said case;

a spring coiled on said spool in said case, said spring having a free end which can be unwound from said spool;

a flexible metalic antenna element in said case, said antenna element having two ends, one said end being connected to said free end of said spring in said case, the other end of said element being free, and said element being normally wound on said spool in said case by the action of said spring, and being adapted to be unwound out of said case through said slot from said spool against said spring action;

an insulating filament connected to said free end of said element;

drive means for moving said filament to unwind said element off said spool whereby to progressively extend said element from said case whereby said element is extended to a desired length of extension from said case for radiation or reception of said electromagnetic radiation; and, electrical connection means in said case adjacent said slot contacting said element adjacent to said spool where it exits through said slot, said element being moveable relative to said connection means.

2. An antenna as claimed in claim 1 and wherein said filament is flexible.

3. An antenna as claimed in claim 2 and including pulley means mounted at a distance from said spool and said filament extending around said pulley means.

4. An antenna as claimed in claim 3 including a reel, said filament being wound on said reel, and means for rotating said reel whereby to extend said element from said case and unwind said element from said spool, said reel being releasable whereby to permit said filament to unwind, thereby in turn permitting said element to rewind into said case on said spool.

5. An antenna as claimed in claim 4 and including a non-conductive housing extending from said spool a predetermined distance and defining two ends, and said spool being mounted at one said end of said housing and said pulley means being mounted at the other said end of said housing.

6. An antenna as claimed in claim 5, including a second said antenna element in said metal case and a second said spool in said metal case and a second said housing for said second antenna and a second said filament, and pulley means and reel, said two antenna elements and housings extending along the same axis in opposite directions, whereby to form a dipole antenna extendible in opposite directions.

* * * * *